United States Patent [19]

Jacobsson et al.

[11] Patent Number: 4,815,655

[45] Date of Patent: Mar. 28, 1989

[54] OPENING ARRANGEMENT FOR PACKING CONTAINERS

[75] Inventors: Kenth Jacobsson, Södra Sandby; Jan Lagerstedt, Malmö, both of Sweden

[73] Assignee: Tetra Pak International AB, Lund, Sweden

[21] Appl. No.: 87,951

[22] Filed: Aug. 14, 1987

Related U.S. Application Data

[63] Continuation of Ser. No. 870,012, Jun. 3, 1986, abandoned.

[30] Foreign Application Priority Data

Jun. 12, 1985 [SE] Sweden ..... 8502902

[51] Int. Cl.[4] ..... B65D 5/70

[52] U.S. Cl. ..... 229/123.2; 220/260; 220/271; 229/125.15

[58] Field of Search ..... 229/7 R, 17 R, 17 G, 229/123.1, 123.2, 125.33, 125.42, 125.15; 220/260, 359, 271, 270

[56] References Cited

U.S. PATENT DOCUMENTS

| | | | |
|---|---|---|---|
| 3,292,828 | 12/1966 | Stuart | 220/260 |
| 3,990,603 | 11/1976 | Brochman | 220/260 |
| 4,108,330 | 8/1978 | Patterson | 220/270 |
| 4,164,303 | 8/1979 | Waterbury | 220/260 |
| 4,312,450 | 1/1982 | Reil | 229/123.2 |
| 4,500,011 | 2/1985 | Brochman | 220/359 |
| 4,585,498 | 4/1986 | Lagerstedt et al. | 220/359 |

FOREIGN PATENT DOCUMENTS 2825482 12/1978 Fed. Rep. of Germany .

*Primary Examiner*—Stephen Marcus
*Assistant Examiner*—Gary E. Elkins
*Attorney, Agent, or Firm*—Burns, Doane, Swecker & Mathis

[57] ABSTRACT

Non-returnable packages for liquid contents, e.g. milk, are made frequently from a flexible packing laminate, and are provided with an opening arrangement in the form of a tear-off strip which covers a pouring opening in the packing container wall. So as to avoid spatter and spillage at the actual moment of opening, an opening arrangement for packing containers is realized comprising a pouring opening (8) which has a projection (8') of small area directed against the direction of tearing of the tearing strip (6). This part of the pouring opening (8) formed as a projection (8') thus will be opened first, and air will flow into the packing container, and the liquid level will drop so that the continued opening can be performed without any risk of spillage. By varying the sealing strength between the tearing strip and the packing laminate an automatic delay of the removal of the tearing strip after the opening of the projecting part can be achieved, which further improves the functioning of the opening arrangement.

11 Claims, 1 Drawing Sheet

OPENING ARRANGEMENT FOR PACKING CONTAINERS

This application is a continuation of application Ser. No. 870,012 filed June 3, 1986, now abandoned.

FIELD OF THE INVENTION

The present invention relates to an opening arrangement for packing containers comprising a packing material with a pouring opening and a tear-off strip covering the same.

BACKGROUND OF THE INVENTION

Packing containers of the type described in EPO Pat. No. 19324, to which reference is made, are manufactured from a flexible packing laminate which comprises different material layers, generally a central carrier layer of paper which is enclosed on both sides by homogeneous plastic layers of thermoplastic material, e.g. polyethylene. The packing laminate is converted by folding and heat-sealing in a known manner to packing containers which are filled with contents, e.g. milk, juice or the like. To allow consumption of the contents of the packing containers the latter are provided with some form of opening arrangement, e.g. a tearing indication or a pouring opening with a tear-off cover strip. In order to prevent spillage of contents when the packing container is opened, the packing container is filled with a slightly smaller amount of contents than what is theoretically possible. This is achieved by making the flexible walls of the packing container curve somewhat inwards when the packing container is completely filled and closed, and in connection with the opening of the packing container air will be sucked in through the opening at the same time as the flexible walls revert to a plane or slightly outwards curved position, and the liquid level will thereby drop. In spite of this a certain spillage occurs occasionally, since the sudden lowering of the liquid level causes spattering from the exposed pouring opening.

The abovementioned inconveniences can be avoided by filling the packing container with a smaller quantity of liquid and thus providing it with so-called headspace, that is to say an air-filled or gas-filled space between the product and the top side of the packing container, which to a certain extent prevents spatter and spillage on opening. However, it is desirable, if possible, to avoid headspace, since this naturally involves an increase in packing material consumption which is not matched by any increase in the volume of packed contents. With certain products it is, moreover, a disadvantage if air is present in the package, and the air has to be replaced, therefore, by some inert gas which complicates the packing process and makes it more expensive

OBJECTS AND SUMMARY OF THE PRESENT INVENTION

It is an object of the present invention to provide an opening arrangement for packing containers, this opening arrangement being not subject to the abovementioned disadvantages, but being simple in its design and easy to handle for the consumer.

It is a further object of the present invention to provide an opening arrangement for packing containers, this opening arrangement making it possible to open completely filled packing containers without the occurrence of any spatter or spillage.

These and other objects have been achieved in accordance with the invention in that an opening arrangement for packing containers, comprising a packing material with a pouring opening and a tear-off strip covering the same, has been given the characteristic that the pouring opening has a projection extending against the direction of tearing of the strip whose area is considerably smaller than the total area of the pouring opening.

Preferred embodiments of the opening arrangement in accordance with the invention have been given, moreover, the characteristics which are evident from the subsidiary claims.

By designing the pouring opening in accordance with the invention with a projection extending against the direction of tearing of the strip, the risk of spatter on opening is eliminated, since the opening process is initiated in the projection which has a very limited area permitting merely the necessary inflow of air into the packing container in connection with the opening, but preventing the occurrence of any splashing and spattering. As soon as the tightness of the packing container has been broken, owing to this limited portion of the pouring opening having been uncovered, the liquid level drops through air flowing into the package and the flexible package walls curving outwards, and the continued opening of the total area of the pouring opening can take place, therefore in the same safe and spillage-free manner as the opening of a package provided with headspace. By designing the opening arrangement in such a manner that the tearing away of the cover-strip is stopped presently,immediately after the projection has been uncovered, an even greater safety against any undesirable spillage is obtained.

BRIEF DESCRIPTION OF THE DRAWING

A preferred embodiment of the opening arrangement in accordance with the invention will now be described in greater detail with special reference to the attached schematic drawing which only shows the details indispensable for an understanding of the invention.

DETAILED DESCRIPTION OF THE PREFERRED EMBODIMENT

Figure 1:
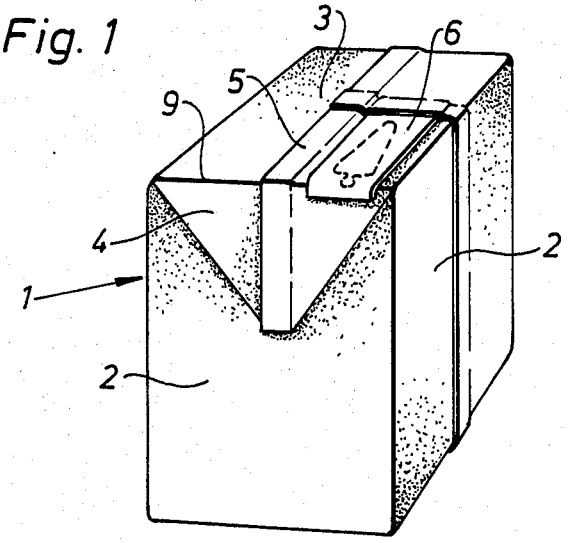
FIG. 1 shows in perspective a packing container of known type provided with an opening arrangement with cover strip.

In FIG. 1 is shown a packing container 1 in perspective, this packing container, as well as its manufacture being described in greater detail in EPO Pat. No. 19324, to which reference is made. The packing container 1 is made of a flexible packing laminate which comprises layers of fibrous material, e.g. paper, and homogeneous plastic layers of thermoplastic material, preferably polyethylene. The packing container 1 is of substantially parallelepipedic shape with four side walls or surfaces 2 and an upper surface 3 and a bottom surface which is not shown. The packing container 1 also has a number of corner lugs 4 and seals 5 which, however, are not relevant in this connection and need not be described, therefore, in any detail. On the top side 3 of the packing container is an opening arrangement in the form of a pouring opening provided with a tear-off cover strip 6.

Figure 2:
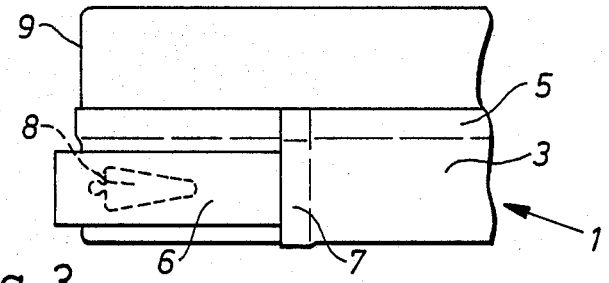
FIG. 2 shows a part of the packing container in accordance with FIG. 1 from the top.

In FIG. 2 is shown on a larger scale a part of the packing container in accordance with FIG. 1 from the top. It is evident from the Figure how the seal 5 extends over the upper surface 3 of the packing container 1, and how a further seal or longitudinal joint 7 extends from the transverse seal 5 and over half the upper surface 3 and further down along one side wall 2 of the packing container (FIG. 1) The cover strip 6 extends from the longitudinal joint 7 over the part of the upper surface 3 of the packing container which is provided with a pouring opening 8 (indicated by means of broken lines in FIG. 2) and out over an edge line 9 which delimits the upper wall of the packing container from an adjoining side wall.

Figure 3:
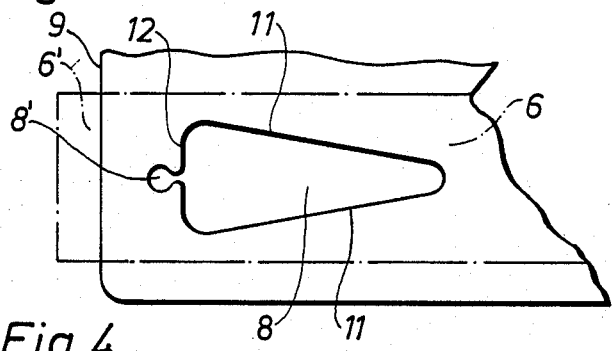
FIG. 3 shows on a larger scale an opening arrangement in accordance with the invention on a packing container.
Figure 4:
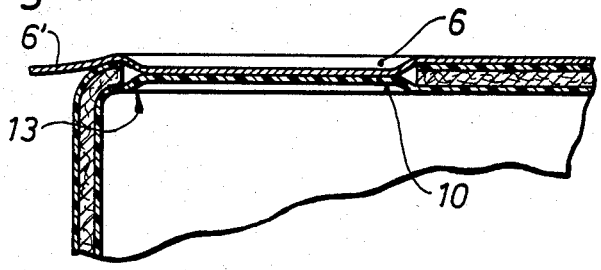
FIG. 4 shows in section the opening arrangement in accordance with FIG. 3.

The form of the pouring opening 8 and the seal between the cover strip 6 and the different material layers of the packing container 1 are illustrated in greater detail in FIG. 3 and FIG. 4.It is evident from FIG. 3 how the pouring opening 8 is placed close to one corner of the upper surface 3 of the packing container and is covered by the cover strip 6, indicated only in FIG. 3, whose one end serves as a grip part 6' and extends out over the edge line 9 of the packing container. FIG. 3 shows further how the pouring opening 8 is provided with a projection 8' extending against the direction of tearing of the cover strip, whose area is considerably smaller than the total area of the pouring opening 8. The cover strip 6 extends over the total area of the pouring opening and over adjoining parts of the packing material, and is sealed to a material layer 10 situated on the opposite side of the packing material, which may be constituted of a loose strip of thermoplastic material or form a part of the packing laminate and constitute, for example, its innermost, liquid-tight thermoplastic layer. The cover strip 6 and the internal material layer 10 in the packing container rest against each other and are sealed to each other within the area of the pouring opening 8. This sealed area is marked in FIG. 3 by a checkered pattern, and it is evident how the sealed area is limited by a line extending along the contour of the pouring opening. In the preferred embodiment shown the cover strip 6 and the internal thermoplastic layer 10 are sealed to each other within the whole area of the pouring opening 8 (except for the said narrow edge zone), but it is also possible, of course, to realize the sealing area as a line which merely extends along the contour of the pouring opening 8 and leave the central area unsealed.

The pouring opening 8 has a substantially elongated form and is limited by two lines 11 which mainly coincide with the tearing direction of the cover strip 6. The lines 11 diverge slightly and the pouring opening consequently is given a narrower rear end and a wider front end which adjoins the edge line 9 of the packing container. At this front end the pouring opening is delimited by a substantially straight line 12 joining together the lines 11, which runs parallel with the edge line 9 and in the central part of which is located the projection 8' of the pouring opening 8. The projection extends in the direction towards the edge line 9 and has a substantially circular form. Its area is small in relation to the total area of the pouring opening 8 and preferably amounts to less than one tenth of the total area. In packages of a typical size, with a volume of e.g. between two and five decilitres , the projection 8' partially may have the form of a circle of a diameter of between two and eight millimetres. Other forms are also possible of course and the projection, for example, may be of triangular or linear appearance, the essential fact being above all that its area is considerably smaller than the total area of the pouring opening and that the transition between the projection and the remaining part of the pouring opening has the form of a sealing line extending parallel with the edge line 9.

When a packing container with an opening arrangement in accordance with the invention is to be opened, the consumer grips the projecting pull-lug 6' of the cover strip 6 and lifts the same upwards. As the lug 6' is pulled the internal liquid-tight layer 10 will rupture at the part of the pouring opening facing away from the direction of pulling, that is to say the projection 8'. Since the area of the projection is very limited, a small force only will be required to break the seal, and as soon as the layer 10 has been ruptured (at the place marked 13 in FIG. 4) the surrounding air will stream into the packing container so that the liquid level in the previously completely filled package drops at the same time as the side walls 2 of the packing container will curve slightly outwards. The contents level will end up ten to twelve millimetres below the top side 3 of the packing container, and the continued opening, that is to say the continued tearing off of the cover strip 6 with simultaneous rupturing of the layer 10 along the edge line of the pouring opening 8, can take place without any risk of the contents splashing or spattering up through the opening.

To ensure that the lower level of the contents in the packing container has time to stabilize itself before the cover strip has been wholly removed from the pouring opening 8 and thus prevent any splashing out through the same, the opening arrangement has been designed in such manner in accordance with the invention that the resistance to the tearing off of the strip varies in the direction of tearing of the cover strip 6. More particularly, the resistance caused by the seal between the cover strip 6 and the inner layer 10 on tearing off the cover strip is greater in the boundary region between the projection 8' of the pouring opening 8 and the main part of the pouring opening than at the other parts of the pouring opening. This has been achieved in that the seal between the tear-off strip 6 and the material layer 10 located at the opposite side of the packing material is limited at the front end of the pouring opening facing away from the direction of tearing by the line 12 extending parallel with the edge line 9. This line or edge 12 thus will be situated at right angles to the direction of tearing of the strip 6 which means that the internal plastic layer 10 has to be induced to rupture along a relatively long sealing distance which offers an appreciably greater resistance than when the part of the seal in the projection 8' which is much more limited in area is to be broken up.

In a preferred embodiment of the opening arrangement in accordance with the invention the projection 8' of the pouring opening has been given a substantially circular form of a diameter between two and eight millimeters. Through a suitable choice of this diameter the projection 8' may serve advantageously as a suction tube hole on the type of packing container intended for being emptied with the help of a suction tube. The consumer here discontinues the tearing off of the cover strip 6 as soon as the projection 8' has been opened (that is to say when the tearing resistance increases), and this will then serve as a suction tube hole.

The opening arrangement in accordance with the invention, of course, can also be given a different form which is adapted to the packing container or the contents the same is intended to be used for. It is possible, for example, to give the pouring opening a more oblong form or to realize it as one or several circular holes, provided only that a projection which is relatively small in area extends from the pouring opening proper against the direction of tearing. Moreover, the transition from the projection to the pouring opening proper must be as marked as possible,of course, in order to obtain the desirable braking effect, referred to earlier, when the strip is torn off.

In the embodiment of the opening arrangement shown the projection 8' of the pouring opening is facing towards the edge line 9 of the packing container over which the product is intended to be poured, but it is also possible, of course, to place the projection 8' on the opposite end of the pouring opening if the tearing of the cover strip 6 too is in the opposite direction.

--It is, of course, possible to embody the invention in other specific forms than those of the preferred embodiment described above. This may be done without departing from the essence of the invention. The preferred embodiment is merely illustrative and should not be considered restrictive any any way. The scope of the invention is embodied in the appended claims rather than in the prceding description and all variations and changes which fall within the range of the claims are intended to be embraced therein.

What is claimed is:

1. An opening arrangement for a packing container comprising:

a pouring opening in the packing container, said pouring opening being defined by an opening perimeter and having a first end and a second end, a tear-off strip covering said pouring opening and removably attached to said packing container, said tear-off strip being removable by tearing said tear-off strip in a direction from said first end toward said second end of said pouring opening, said pouring opening having a straight edge at said first end extending in a direction perpendicular to said tearing direction, and a projection opening adjacent to and centrally located along said edge, said projection opening dividing said edge into two edge portions.

2. An opening arrangement in accordance with claim 1, wherein said pouring opening has an elongated shape and is limited by two lines substantially coinciding with the tearing direction of the strip , said two lines being joined together at said first end of said pouring opening by said edge.

3. An opening arrangement in accordance with claim 1, wherein said projection has an area which is less than one tenth of the total area of said pouring opening.

4. An opening arrangement in accordance with claim 1, wherein said projection is partially of circular form having a diameter of two to eight millimeters.

5. An opening arrangement for a packing container comprising:

a pouring opening in the packing container, said pouring opening being defined by an opening perimeter and having a first end and a second end, a tear-off strip covering said pouring opening and removably attached to said packing container, said tear-off strip being removable by tearing said tear-off strip in a direction from said first end toward said second end of said pouring opening, said pouring opening having a straight edge at said first end extending in a direction perpendicular to said tearing direction, a projection opening adjacent to and centrally located along said edge, said projection opening dividing said edge into two edge portions, a material layer extending over said pouring opening inside the packing container, said material layer being sealed with said tear-off strip at least along said edge within the area of said pouring opening, the seal along said edge being resistant to tearing of said tear-off strip to provide that a greater resistance to tearing exists at said edge than at other positions in the tearing direction.

6. An opening arrangement in accordance with claim 5 wherein the seal between said tear-off strip and said material layer is limited by a seal line extending along said opening perimeter of said pouring opening which at said edge extends in a direction perpendicular to the tearing direction of the tear-off strip.

7. An opening arrangement in accordance with claim 5, wherein the seal is linear and extends along said perimeter of said pouring opening.

8. An opening arrangement for a liquid container of the type having a top wall, and side walls intersecting said top wall, said top wall being in the form of a flexible packing laminate having a central carrier layer with external and internal surface layers covering said carrier layer, said arrangement comprising:

a pouring opening in said top wall, said opening having a straight transverse edge adjacent the intersection with said side wall;

a tear-off strip extending over said pouring opening and extending in overlapping relationship with said intersection to form a pull-lug;

said external layer having an opening coincident with said pouring opening and said internal layer extending across said pouring opening, said tear-off strip and said internal strip being sealed together at said pouring opening;

said pouring opening including a projecting extending toward said intersection and located intermediate ends of said transverse edge, said projection having a substantially smaller area than the remaining area of said pouring opening, whereby less force is required to tear said internal layer under said projection and air may enter said container through said projection prior to opening the remainder of said pouring opening.

9. The opening arrangement according to claim 8 wherein said transverse edge extends parallel to said intersection, said projection extending away from said transverse edge and dividing said transverse edge into two edge portions.

10. The opening arrangement according to claim 9 wherein said pouring opening is substantially triangular.

11. The opening arrangement according to claim 8 wherein said projection is substantially circular.

* * * * *